US011265989B2

(12) United States Patent
Graff et al.

(10) Patent No.: US 11,265,989 B2
(45) Date of Patent: Mar. 1, 2022

(54) LOW VOLTAGE LED LIGHTING FIXTURE

(71) Applicant: Appleton Grp LLC, Rosemont, IL (US)

(72) Inventors: Timothy E. Graff, Arlington Heighls, IL (US); Pankaj P. Tikle, Pune (IN); Ajay Tripathi, Libertyville, IL (US)

(73) Assignee: Appleton Grp LLC, Rosemont, IL (US)

( * ) Notice: Subject to any disclaimer, the term of this patent is extended or adjusted under 35 U.S.C. 154(b) by 50 days.

(21) Appl. No.: 16/860,933

(22) Filed: Apr. 28, 2020

(65) Prior Publication Data

US 2020/0352000 A1 Nov. 5, 2020

(30) Foreign Application Priority Data

May 3, 2019 (IN) ..... 201921017826

(51) Int. Cl.

| | |
|---|---|
| ***H05B 45/3725*** | (2020.01) |
| ***H05B 45/14*** | (2020.01) |
| ***H05B 45/50*** | (2020.01) |
| ***H05B 47/17*** | (2020.01) |
| ***F21V 23/00*** | (2015.01) |
| ***F21Y 115/10*** | (2016.01) |

(52) U.S. Cl.

CPC ..... *H05B 45/3725* (2020.01); *F21V 23/003* (2013.01); *H05B 45/14* (2020.01); *H05B 45/50* (2020.01); *H05B 47/17* (2020.01); *F21Y 2115/10* (2016.08)

(58) Field of Classification Search

CPC .... H05B 45/3725; H05B 45/14; H05B 45/50; H05B 47/17; F21V 23/003; F21Y 2115/10

See application file for complete search history.

(56) References Cited

U.S. PATENT DOCUMENTS

2010/0013395 A1 1/2010 Archibald et al.
2010/0280677 A1* 11/2010 Budike, Jr. ..... H05B 47/19 700/296
2011/0140614 A1* 6/2011 Young ..... H05B 45/3725 315/185 R (Continued)

FOREIGN PATENT DOCUMENTS

EP 2477459 B1 1/2016

*Primary Examiner* — Raymond R Chai

(74) *Attorney, Agent, or Firm* — McDonnell Boehnen Hulbert & Berghoff LLP

(57) ABSTRACT

A low voltage lighting system including a fixture (200) having an array of LEDs (204) and an LED driver circuit (202). The LED driver circuit (202) includes a Switch-mode Power Supply (SMPS) unit (206), a current sensing unit (210), a control unit (208) and a dimming input level shifting and signal conditioning unit (212). The SMPS unit (206) produces an adequate DC power ($+V_{LED}$, $-V_{LED}$) for driving the LEDs (204). The control unit (208) receives a sensed current signal from the current sensing unit (210) and controls the SMPS unit (206) to maintain the output current within a pre-determined range. The control unit (208) receives a dimming signal from the dimming unit (212) or an emergency signal from a supply unit (104) to alter the output power of the SMPS unit (206) from normal mode to dimming mode or emergency mode respectively.

16 Claims, 4 Drawing Sheets

(56) References Cited

U.S. PATENT DOCUMENTS

| | | | | |
|---|---|---|---|---|
| 2014/0300282 | A1* | 10/2014 | Grave | H05B 45/10 315/185 R |
| 2017/0086272 | A1* | 3/2017 | O'Neil | H05B 47/105 |
| 2018/0102672 | A1* | 4/2018 | Qiu | F21S 9/022 |
| 2020/0137847 | A1* | 4/2020 | Tetreault | H05B 47/175 |
| 2020/0296813 | A1* | 9/2020 | Saes | H05B 45/44 |

* cited by examiner

LOW VOLTAGE LED LIGHTING FIXTURE

RELATED APPLICATIONS

This application claims priority to Indian Patent Application No. 201921017826 entitled "A Low Voltage LED Lighting Fixture" filed on May 3, 2019, which is hereby incorporated by reference in its entirety.

FIELD

The present disclosure relates to the field of low voltage lighting systems.

Definitions

As used in the present disclosure, the following terms are generally intended to have the meaning as set forth below, except to the extent that the context in which they are used indicate otherwise.

Normal mode—The term "normal mode" hereinafter refers to a mode of operation of a lighting system in which the lights draw power from the mains and glow at full brightness.

Emergency mode—The term "emergency mode" hereinafter refers to a mode of operation of a lighting system that automatically comes on when the normal mode (i.e. the main power supply) fails and the light glows at a pre-defined brightness.

Dimming mode—The term "dimming mode" hereinafter refers to a mode of operation of a lighting system which is activated by an operator to lower the brightness of lights present in the lighting system.

BACKGROUND

The background information herein below relates to the present disclosure but is not necessarily prior art.

Typically, LED lighting systems are provided with a central power supply which includes an AC to DC converter. The DC power obtained from the converter is distributed to a plurality of driver circuits of LED lamps. Each driver circuit includes a DC to DC converter for converting the DC power to a DC power of sufficient voltage to operate the associated LEDs. Batteries are provided to supply the DC power when the AC input power from the central power supply fails. The existing LED lighting systems mostly operate at high voltages, making their wiring and maintenance difficult.

Further, the prevailing hazardous area emergency lighting fixtures include a battery pack and Battery Management Module (BMM). Since the battery and BMM are within the fixture, the risk of hazard is high as the fixture is located in a Zone 1 environment. Moreover, these fixtures are large in size and complex to design.

Therefore, there is felt a need to provide a low voltage LED lighting fixture that is smaller in size, has a simple assembly, is energy efficient, and ensures safe operation.

Objects

Some of the objects of the present disclosure, which at least one embodiment herein satisfies, are as follows:

It is an object of the present disclosure to ameliorate one or more problems of the prior art or to at least provide a useful alternative.

An object of the present disclosure is to provide a low voltage LED lighting fixture.

Another object of the present disclosure is to provide a low voltage LED lighting fixture that has a smaller filament and bulb size.

Still another object of the present disclosure is to provide a low voltage LED lighting fixture that uses a low voltage battery pack as an emergency backup for providing dimmed power to the LEDs.

Yet another object of the present disclosure is to provide a low voltage LED lighting fixture that is energy efficient.

Still another object of the present disclosure is to provide a low voltage LED lighting fixture that is cost effective.

Yet another object of the present disclosure is to provide a low voltage LED lighting fixture that can be employed in a Zone 1 environment with minimal risk of hazard.

Still another object of the present disclosure is to provide a low voltage LED lighting fixture that facilitates the user to dim the LED lamp.

Yet another object of the present disclosure is to provide a low voltage LED lighting fixture that facilitates the user to enable/disable the dimming control.

Still another object of the present disclosure is to provide a low voltage LED lighting fixture that has a simple assembly.

Other objects and advantages of the present disclosure will be more apparent from the following description, which is not intended to limit the scope of the present disclosure.

SUMMARY

The present disclosure envisages a Low Voltage (LV) LED lighting fixture. The fixture includes at least one array of LEDs and an LED driver circuit. The LED driver circuit includes a Switch-mode Power Supply (SMPS) unit, a current sensing unit, a control unit, and a dimming input level shifting and signal conditioning unit. The SMPS unit is configured to receive an input DC power ($+V_{IN}$, $-V_{IN}$) from a DC power supply unit and is further configured to supply an adequate DC power ($+V_{LED}$, $-V_{LED}$) to drive the LED array. The current sensing unit is configured to continuously sense the output current of the SMPS unit and is further configured to generate a digital sensed current signal. The dimming input level shifting and signal conditioning unit is configured to receive an analog dimming input voltage signal ($+V_{DIM}$, $-V_{DIM}$) from an external device for controlling the brightness of the LED array and is further configured to generate a control voltage signal based on the received analog dimming input voltage signal ($+V_{EMG}$, $-V_{DIM}$). The control unit is configured to receive the digital sensed current signal from the current sensing unit, the control voltage signal from the dimming input level shifting and signal conditioning unit, and an emergency input signal ($+V_{EMG}$, $-V_{EMG}$) from the DC power supply unit and is further configured to alter the output power of the SMPS unit to switch from normal mode to:

- a dimming mode based on the received control voltage signal; or
- an emergency mode based on the received emergency input signal ($+V_{EMG}$, $-V_{EMG}$).

In an embodiment, the control unit is configured to compare the received digital sensed current signal with a pre-determined threshold range to maintain the output current of the SMPS unit within the pre-determined range.

In an embodiment, the DC power supply unit includes an AC-DC converter, a battery pack, and a changeover switch. The AC-DC converter is configured to receive an alternating current (AC) power from an alternating current (AC) source and is further configured to convert the received AC power to a low voltage DC power. The changeover switch is configured to automatically switch the source of power supply from the AC-DC converter to the battery pack during the emergency mode of operation.

In an embodiment, the control unit is configured to enable the emergency mode of operation when the emergency input signal ($+V_{EMG}$, $-V_{EMG}$) of the range 15V to 25V is received from the DC power supply unit. The control unit is further configured to disable the emergency mode of operation when the emergency input signal ($+V_{EMG}$, $-V_{EMG}$) of the range 0V to 5V is received from the DC power supply unit. The DC power supply unit is configured to supply the emergency input signal ($+V_{EMG}$, $-V_{EMG}$) of the range 15V to 25V when the supply from the AC source fails.

In an embodiment, the output current is programmable in the range of 0.35-1.3 Amperes by means of the control unit. The brightness of the LED array is proportional to the output current.

In an embodiment, the external device is configured to generate the analog dimming input voltage signal ($+V_{DIM}$, $-V_{DIM}$) and is further configured to facilitate a user to alter the analog dimming input voltage signal ($+V_{DIM}$, $-V_{DIM}$) for controlling the dimming level of the LED array. The output current of the SMPS unit is proportional to the received analog dimming input voltage signal ($+V_{DIM}$, $-V_{DIM}$). In an embodiment, the analog dimming input voltage signal ($+V_{DIM}$, $-V_{DIM}$) ranges from 0V to 10V. In another embodiment, the analog dimming input voltage signal ($+V_{DIM}$, $-V_{DIM}$) is varied from 1V to 8V to facilitate dimming of the LED array from 10% to 100% respectively during the normal mode of operation. In yet another embodiment, the dimming input level shifting and signal conditioning unit is configured to convert the received 0-10V DC analog dimming input voltage signal ($+V_{DIM}$, $-V_{DIM}$) into the 0-3.3 V DC control voltage signal for the control unit. In still another embodiment, the analog dimming input voltage signal ($+V_{DIM}$, $-V_{DIM}$) is reduced below 0.5V to disable the dimming control of the LED array.

In an embodiment, the fixture is designed to be Zone 1 compliant.

In an embodiment, the DC power supply unit is designed to be Zone 2 compliant.

In an embodiment, the control unit is configured to facilitate setting the minimum dimming level to 10, 20, 30, 40, or 50% of the output current for normal mode of operation. In another embodiment, the control unit is further configured to facilitate setting the dimming level to 20, 30, 40, or 50% of the output current for emergency mode of operation.

In an embodiment, the emergency input signal ($+V_{EMG}$, $-V_{EMG}$) is provided by means of a potential free contact of the changeover switch to the control unit input of the LED driver circuit.

BRIEF DESCRIPTION OF THE ACCOMPANYING DRAWING

A low voltage LED lighting fixture of the present disclosure will now be described with the help of the accompanying drawing, in which.

LIST OF REFERENCE NUMERALS

100—DC power supply unit
102—AC-DC converter
104—Changeover switch
106—Battery pack
108—Alternating Current (AC) source
200—Low voltage LED lighting fixture
202—LED driver circuit
204—LED array
206—SMPS unit
208—Control unit
210—Current sensing unit
212—Dimming input level shifting and signal conditioning unit

DETAILED DESCRIPTION

Embodiments, of the present disclosure, will now be described with reference to the accompanying drawing.

Embodiments are provided so as to thoroughly and fully convey the scope of the present disclosure to the person skilled in the art. Numerous details, are set forth, relating to specific components, and methods, to provide a complete understanding of embodiments of the present disclosure. It will be apparent to the person skilled in the art that the details provided in the embodiments should not be construed to limit the scope of the present disclosure. In some embodiments, well-known processes, well-known apparatus structures, and well-known techniques are not described in detail.

The terminology used, in the present disclosure, is only for the purpose of explaining a particular embodiment and such terminology shall not be considered to limit the scope of the present disclosure. As used in the present disclosure, the forms "a," "an," and "the" may be intended to include the plural forms as well, unless the context clearly suggests otherwise. The terms "comprises," "comprising," "including," and "having," are open ended transitional phrases and therefore specify the presence of stated features, integers, steps, operations, elements, modules, units and/or components, but do not forbid the presence or addition of one or more other features, integers, elements, components, and/or groups thereof.

Figure 1:
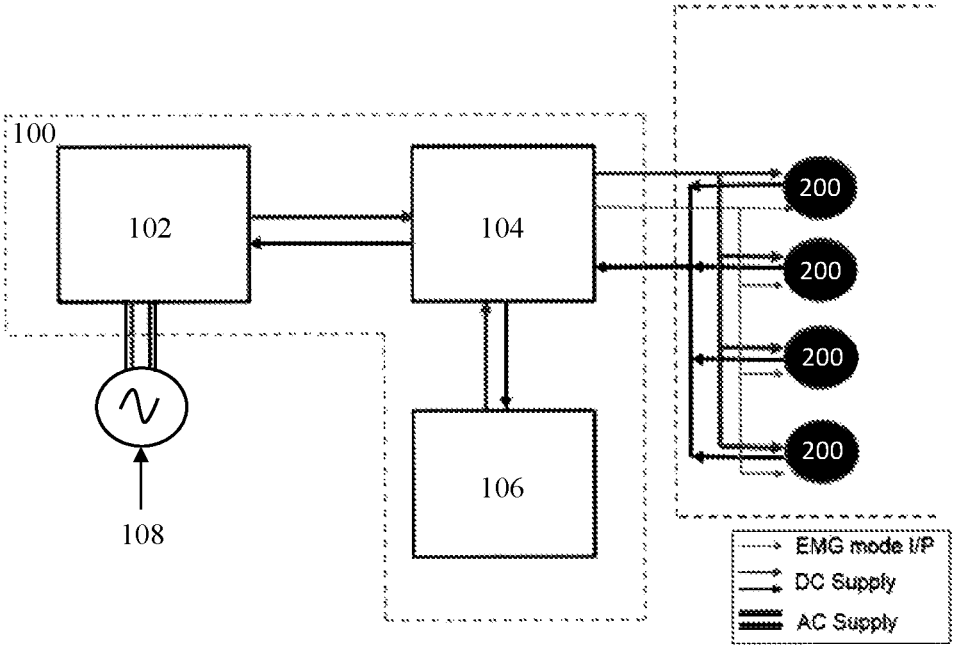
FIG. 1 illustrates a block diagram of DC system for driving a low voltage LED lighting fixture.
Figure 2:
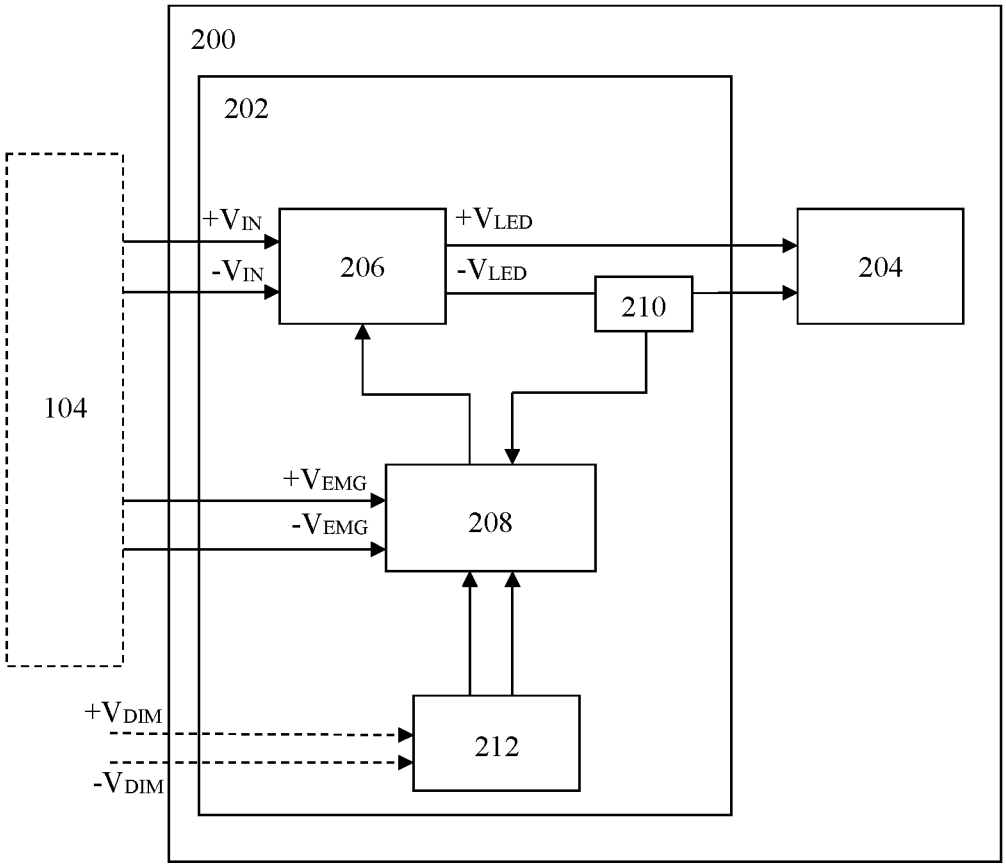
FIG. 2 illustrates a block diagram of the low voltage LED lighting fixture of FIG. 1.

A Low Voltage LED lighting fixture (hereinafter referred to as "fixture 200") of the present disclosure is now being described with reference to FIG. 1 through FIG. 3B. Referring to FIGS. 1 and 2, the fixture 200 comprises at least one array of LEDs 204 and an LED driver circuit 202. The LED driver circuit 202 includes a Switch-mode Power Supply (SMPS) unit 206, a current sensing unit 210, a control unit 208, and a dimming input level shifting and signal conditioning unit 212. The Switch-mode Power Supply (SMPS) unit 206 is configured to receive an input DC power ($+V_{IN}$, $-V_{IN}$) from a DC power supply unit 100. The voltage of the received input DC power ($+V_{IN}$, $-V_{IN}$) ranges from 20V to 55V DC. The SMPS unit 206 is further configured to supply an adequate DC power ($+V_{LED}$, $-V_{LED}$) to drive the LED array 204. In an embodiment, the SMPS unit 206 includes a DC-DC converter to reduce or increase the voltage of received input DC power ($+V_{IN}$, $-V_{IN}$) to an adequate voltage ($+V_{LED}$, $-V_{LED}$) for driving the LEDs 204. In an embodiment, the DC-DC converter is a buck-boost converter. The current sensing unit 210 is configured to continuously sense the output current of the SMPS unit 206 and is further configured to generate a digital sensed current signal. The output current of the SMPS unit 206 may range from 0.13 to 1.3 Amperes. In an embodiment, the current sensing unit 210 includes a current sensing element, a filter, and an Analog to Digital Converter (ADC). The current sensing element is configured to continuously sense the output current of SMPS unit 206 and is further configured to generate an analog sensed current signal. The filter is configured to receive the analog sensed current signal and filter out unwanted frequencies from the analog sensed current signal to generate a filtered sensed current signal. The ADC is configured to receive the filtered sensed current signal and is further configured to generate a digital sensed current signal corresponding to the filtered sensed current signal. The dimming input level shifting and signal conditioning unit 212 is configured to receive an analog dimming input voltage signal ($+V_{DIM}$, $-V_{DIM}$) from an external device for controlling the brightness of the LED array 204 and is further configured to generate a control voltage signal based on the received analog dimming input voltage signal ($+V_{DIM}$, $-V_{DIM}$). The control unit 208 is configured to receive the digital sensed current signal from the current sensing unit 210, the control voltage signal from the dimming input level shifting and signal conditioning unit 212, and an emergency input signal ($+V_{EMG}$, $-V_{EMG}$) from the DC power supply unit 100 and is further configured to alter the output power of the SMPS unit 206 to switch from normal mode to:

- a dimming mode based on the received control voltage signal; or
- an emergency mode based on the received emergency input signal ($+V_{EMG}$, $-V_{EMG}$).

In an embodiment, the control unit 208 is configured to compare the received digital sensed current signal with a pre-determined threshold range to maintain the output current of the SMPS unit 206 within the pre-determined range. In an embodiment, the control unit 208 is configured to facilitate a user to program the output current in the range of 0.35-1.3 Amperes. In an embodiment, the pre-determined threshold range is set to ±5% of the output current.

In an embodiment, the DC power supply unit 100 includes an AC-DC converter 102, a battery pack 106, and a changeover switch 104. The AC-DC converter 102 is configured to receive an alternating current (AC) power from an alternating current (AC) source 108 and is further configured to convert the received AC power to a low voltage DC power. The changeover switch 104 is configured to automatically switch the source of power supply from the AC-DC converter 102 to the battery pack 106 during the emergency mode of operation.

In an embodiment, the control unit 208 is configured to enable the emergency mode of operation when the emergency input signal ($+V_{EMG}$, $-V_{EMG}$) of the range 15V to 25V is received from the DC power supply unit 100. In another embodiment, the control unit 208 is configured to disable the emergency mode of operation when the emergency input signal ($+V_{EMG}$, $-V_{EMG}$) of the range 0V to 5V is received from the DC power supply unit 100. The DC power supply unit 100 is configured to supply the emergency input signal ($+V_{EMG}$, $-V_{EMG}$) of the range 15V to 25V when the supply from the AC source 108 fails. In this case, the SMPS unit 206 is configured to draw DC power for the operation of the LEDs 204 from the battery pack 106. The control unit 208 may be implemented using one or more microprocessors, microcomputers, micro-controllers, digital signal processors, central processing units, state machines, logic circuitries, and/or any devices that manipulate signals based on operational instructions.

In an embodiment, the emergency input signal ($+V_{EMG}$, $-V_{EMG}$) is provided by means of a potential free contact of the changeover switch 104 to the control unit input of the LED driver circuit 202. The control unit 208 is configured such that when the emergency input signal ($+V_{EMG}$, $-V_{EMG}$) lies in the range of 0 to 5V, the logic level is set to 0 and the fixture 200 operates in normal mode. Similarly, when the emergency input signal ($+V_{EMG}$, $-V_{EMG}$) lies in the range of 15 to 24V, the logic level is set to 1 and the fixture 200 operates in emergency mode.

In an embodiment, the output current of the SMPS unit 206 under normal mode of operation is such that the LED array 204 glows with maximum brightness.

In an embodiment, the control unit 208 is configured to facilitate setting the dimming level to 20, 30, 40, or 50% for emergency mode of operation. Dimming the fixture 200 during emergency mode of operation reduces energy consumption, thereby ensuring longer battery backup time.

In an embodiment, the external device is configured to generate the analog dimming input voltage signal ($+V_{DIM}$, $-V_{DIM}$) and is further configured to facilitate a user to alter the analog dimming voltage signal ($+V_{DIM}$, $-V_{DIM}$) for controlling the dimming level of the LED array 204. The brightness of the LED array 204 is proportional to the output current of the SMPS unit 206. Further, the output current of the SMPS unit 206 is configured to be proportional to the received analog dimming input voltage signal ($+V_{DIM}$, $-V_{DIM}$). The analog dimming input voltage signal ($+V_{DIM}$, $-V_{DIM}$) may range from 0V to 10V. The analog dimming input voltage signal ($+V_{DIM}$, $-V_{DIM}$) is varied from 1V to 8V to facilitate dimming of the LED array 204 from 10% to 100% respectively during the dimming mode of operation. In an embodiment, the dimming input level shifting and signal conditioning unit 212 is configured to convert the received 0-10V DC analog dimming input voltage signal ($+V_{DIM}$, $-V_{DIM}$) into the 0-3.3 V DC control voltage signal for the control unit 208. In another embodiment, the dimming input level shifting and signal conditioning unit 212 is configured to facilitate the user to disable dimming control of the LED array 204 by reducing the analog dimming input voltage signal ($+V_{DIM}$, $-V_{DIM}$) below 0.5V. In still another embodiment, the dimming input level shifting and signal conditioning unit 212 is configured to facilitate setting the minimum dimming level to 10, 20, 30, 40, or 50% for normal mode of operation. Dimming of LEDs 204 not only reduces the energy consumption, but also increases flexibility in usage of the fixture 200 by enabling control at an individual level.

Figure 3A:
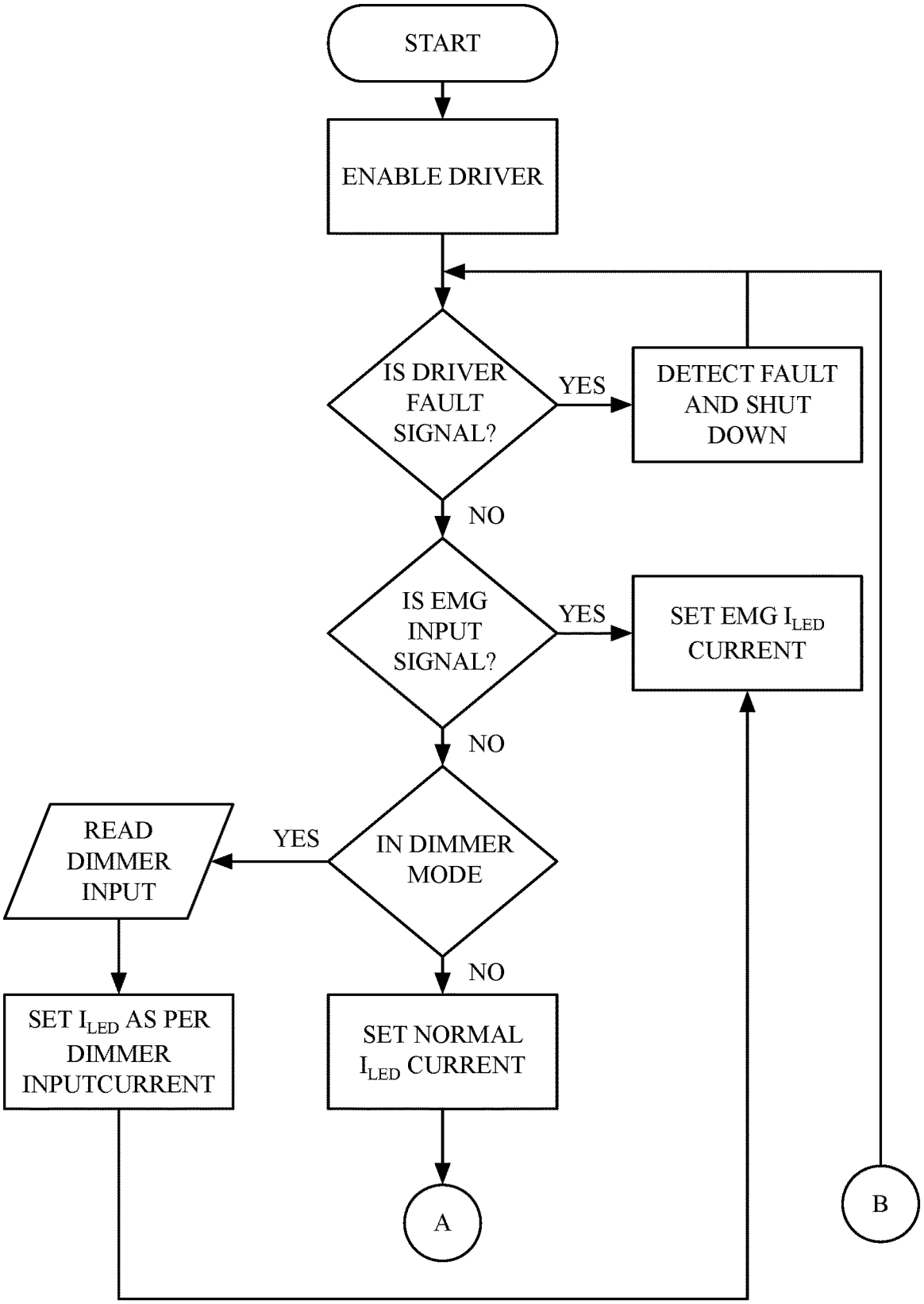
FIGS. 3A and 3B illustrate a flow diagram depicting the operation of the control unit of FIG. 2.
Figure 3B:
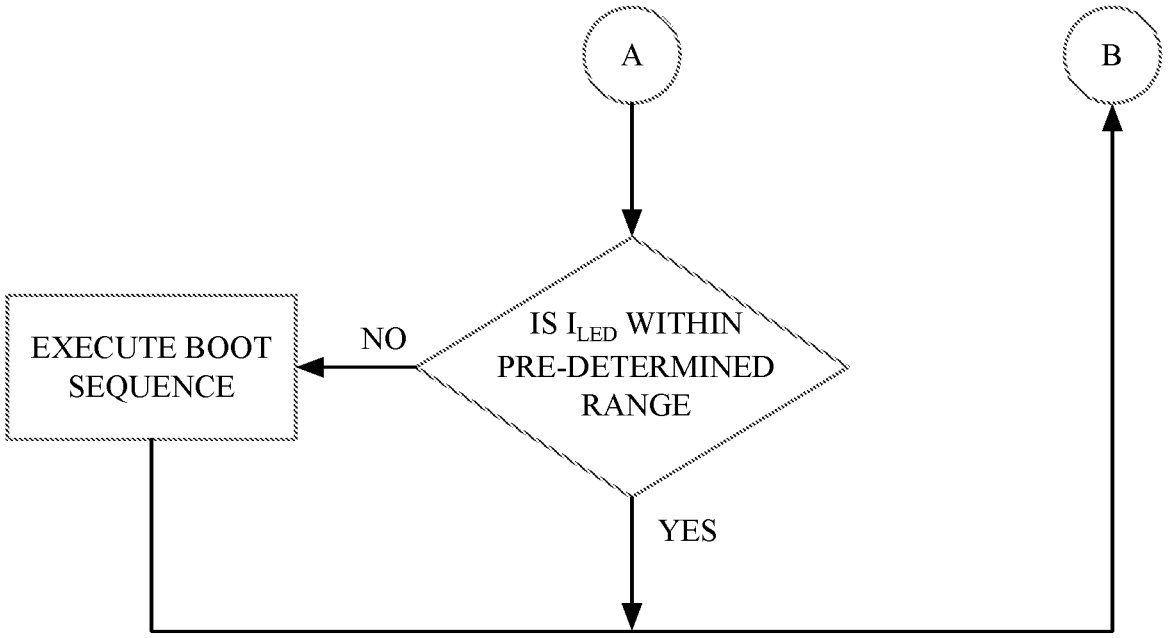

Referring to FIGS. 3A and 3B, the functional behavior of the control unit 208 is depicted by a flow chart. Under normal mode of operation, the SMPS unit 206 is configured to supply a fixed DC power to the LED array 204. The brightness of the LED array 204 is proportional to the output current of the SMPS unit 206. If an analog dimming input voltage signal ($+V_{DIM}$, $-V_{DIM}$) is received from a user, the output current of SMPS unit 206 is set based on the received dimming input voltage signal ($+V_{DIM}$, $-V_{DIM}$) and the LEDs 204 are dimmed accordingly. When emergency input signal ($+V_{EMG}$, $-V_{EMG}$) is received from the DC power supply unit 100, the output current of the SMPS unit 206 is reduced to a value corresponding to the configured emergency mode dimming level. The output current is continuously sensed and the SMPS unit 206 is controlled to maintain the output current within the pre-determined range.

In an embodiment, the fixture 200 is designed to be Zone 1 compliant. Advantageously, the DC power supply unit 100 is located at a remote station and is designed to be Zone 2 compliant, thereby reducing the risk of hazard in the fixture 200 located in a Zone 1 environment. Locating the DC power supply unit 100 in a risk free environment greatly reduces the complexity in designing the fixture 200. Further, the cost involved in providing enclosures suitable for use in Zone 1 is also reduced.

The foregoing description of the embodiments has been provided for purposes of illustration and not intended to limit the scope of the present disclosure. Individual components of a particular embodiment are generally not limited to that particular embodiment, but, are interchangeable. Such variations are not to be regarded as a departure from the present disclosure, and all such modifications are considered to be within the scope of the present disclosure.

TECHNICAL ADVANCEMENTS

The present disclosure described herein above has several technical advantages including, but not limited to, the realization of a low voltage LED lighting fixture that:

- has a smaller filament and bulb size;
- requires a low voltage battery pack as an emergency backup for providing dimmed power to the lamp;
- is energy saving;
- is cost effective;
- facilitates the user to dim the LED lamp;
- facilitates the user to enable/disable the dimming control;
- allows a single emergency lighting system to operate multiple such lighting fixtures simultaneously and provide full light output under normal power conditions, thereby potentially avoiding installation and maintenance of multiple separate emergency fixtures;
- has a simple assembly; and
- can be employed in a Zone 1 environment with minimal risk of hazard.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The foregoing description of the specific embodiments so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

The use of the expression "at least" or "at least one" suggests the use of one or more elements or ingredients or quantities, as the use may be in the embodiment of the disclosure to achieve one or more of the desired objects or results.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation.

We claim:

1. A Low Voltage LED lighting fixture comprising:

at least one array of LEDs; and an LED driver circuit comprising:

a Switch-mode Power Supply (SMPS) unit configured to receive an input DC power from a DC power supply unit, and further configured to supply an adequate DC power to drive the LED array;

a current sensing unit configured to continuously sense the output current of the SMPS unit, and further configured to generate a digital sensed current signal;

a dimming input level shifting and signal conditioning unit configured to receive an analog dimming input voltage signal from an external device for controlling the brightness of the LED array, and further configured to generate a control voltage signal based on the received analog dimming input voltage signal; and a control unit configured to receive the digital sensed current signal from the current sensing unit, the control voltage signal from the dimming input level shifting and signal conditioning unit, and an emergency input signal from the DC power supply unit, and further configured to alter the output power of the SMPS unit to switch from normal mode to:

a dimming mode based on the received control voltage signal; or an emergency mode based on the received emergency input signal wherein the DC power supply unit includes:

an AC-DC converter configured to receive an alternating current (AC) power from an alternating current (AC) source, and further configured to convert the received AC power to a low voltage DC power;

a battery pack; and a changeover switch configured to automatically switch the source of power supply from the AC-DC converter to the battery pack during the emergency mode of operation, wherein the DC power supply unit is configured to supply the emergency input signal of the range 15V to 25V when the supply from the AC source fails.

2. The fixture as claimed in claim 1, wherein the control unit is configured to compare the received digital sensed current signal with a pre-determined threshold range to maintain the output current of the SMPS unit within the pre-determined range.

3. The fixture as claimed in claim 1, wherein the external device is configured to generate the analog dimming input voltage signal and is further configured to facilitate a user to alter the analog dimming input voltage signal for controlling the dimming level of the LED array.

4. The fixture as claimed in claim 1, wherein the brightness of the LED array is proportional to the output current.

5. The fixture as claimed in claim 1, wherein output current of the SMPS unit is programmable in the range of 0.35-1.3 Amperes by means of the control unit.

6. The fixture as claimed in claim 1, wherein the output current of the SMPS unit is proportional to the received analog dimming input voltage signal.

7. The fixture as claimed in claim 1, wherein the analog dimming input voltage signal ranges from 0V to 10V.

8. The fixture as claimed in claim 1, wherein the analog dimming input voltage signal is varied from 1V to 8V to facilitate dimming of the LED array from 10% to 100% respectively during the dimming mode of operation.

9. The fixture as claimed in claim 7, wherein the dimming input level shifting and signal conditioning unit is configured to convert the received 0-10V DC analog dimming input voltage signal into the 0-3.3 V DC control voltage signal for the control unit.

10. The fixture as claimed in claim 1, wherein the analog dimming input voltage signal is reduced below 0.5V to disable dimming control of the LED array.

11. The fixture as claimed in claim 1, which is designed to be Zone 1 compliant.

12. The fixture as claimed in claim 1, wherein the DC power supply unit is designed to be Zone 2 compliant.

13. The fixture as claimed in claim 1, wherein the control unit is configured to facilitate setting the minimum dimming level to 10, 20, 30, 40, or 50% during dimming mode of operation.

14. The fixture as claimed in claim 1, wherein the control unit is further configured to facilitate setting the dimming level to 20, 30, 40, or 50% for emergency mode of operation.

15. The fixture as claimed in claim 1, wherein the emergency input signal is provided by means of a potential free contact to the LED driver circuit.

16. A Low Voltage LED lighting fixture comprising:

at least one array of LEDs; and an LED driver circuit comprising:

a Switch-mode Power Supply (SMPS) unit configured to receive an input DC power from a DC power supply unit, and further configured to supply an adequate DC power to drive the LED array;

a current sensing unit configured to continuously sense the output current of the SMPS unit, and further configured to generate a digital sensed current signal;

a dimming input level shifting and signal conditioning unit configured to receive an analog dimming input voltage signal an external device for controlling the brightness of the LED array, and further configured to generate a control voltage signal based on the received analog dimming input voltage signal; and a control unit configured to receive the digital sensed current signal from the current sensing unit, the control voltage signal from the dimming input level shifting and signal conditioning unit, and an emergency input signal from the DC power supply unit, and further configured to alter the output power of the SMPS unit to switch from normal mode to:

a dimming mode based on the received control voltage signal; or an emergency mode based on the received emergency input signal wherein the control unit is configured to enable the emergency mode of operation when the emergency input signal of the range 15V to 25V is received from the DC power supply unit and is further configured to disable the emergency mode of operation when the emergency input signal of the range 0V to 5V is received from the DC power supply unit.

* * * * *